US008128171B2

(12) United States Patent
Tsai

(10) Patent No.: US 8,128,171 B2
(45) Date of Patent: Mar. 6, 2012

(54) CHAIR ARMREST ASSEMBLY HAVING ADJUSTABLE HEIGHT

(76) Inventor: Po-Chuan Tsai, Tainan Hsien (TW)

( * ) Notice: Subject to any disclaimer, the term of this patent is extended or adjusted under 35 U.S.C. 154(b) by 148 days.

(21) Appl. No.: 12/721,794

(22) Filed: Mar. 11, 2010

(65) Prior Publication Data

US 2011/0221251 A1 Sep. 15, 2011

(51) Int. Cl.
*A47C 7/54* (2006.01)

(52) U.S. Cl. ..... 297/411.36

(58) Field of Classification Search ..... 297/411.36, 297/353

See application file for complete search history.

(56) References Cited

U.S. PATENT DOCUMENTS 6,619,746 B2 * 9/2003 Roslund et al. ..... 297/411.36 X
7,156,466 B1 * 1/2007 Chang ..... 297/411.36 X
7,556,316 B1 * 7/2009 Lai ..... 297/411.36
7,611,206 B2 * 11/2009 Tsai ..... 297/411.36
7,703,853 B2 * 4/2010 Hung ..... 297/378.12

* cited by examiner

*Primary Examiner* — Anthony D Barfield
(74) *Attorney, Agent, or Firm* — Alan Kamrath; Kamrath IP Lawfirm, PA

(57) ABSTRACT

An armrest assembly for a chair includes an armrest support, a mounting sleeve movably mounted on the armrest support, an armrest mounted on the mounting sleeve to move in concert with the mounting sleeve, and a lifting device mounted between the armrest support and the mounting sleeve and operable between a first position where the lifting device is locked to lock the mounting sleeve onto the armrest support and a second position where the lifting device is unlocked to unlock the mounting sleeve from the armrest support so that the mounting sleeve is movable relative to the armrest support freely. Thus, the mounting sleeve is movable relative to the armrest support so as to adjust the height of the armrest so that the height of the armrest is adjusted freely to support a user's arm comfortably.

18 Claims, 7 Drawing Sheets

CHAIR ARMREST ASSEMBLY HAVING ADJUSTABLE HEIGHT

BACKGROUND OF THE INVENTION

1. Field of the Invention

The present invention relates to an armrest assembly and, more particularly, to an armrest assembly for a chair.

2. Description of the Related Art

A conventional lift device for a chair armrest comprises an upright support post, an adjusting pipe movably mounted on the support post and detachably locked on the support post by a locking member, and an armrest support mounted on the upper end of the support post. Thus, when the adjusting pipe is unlocked from the locking member, the adjusting pipe is movable relative to the support post to adjust the height of the armrest support relative to the support post so as to adjust the height of the chair armrest.

BRIEF SUMMARY OF THE INVENTION

In accordance with the present invention, there is provided an armrest assembly, comprising an armrest support, a mounting sleeve movably mounted on the armrest support, an armrest mounted on the mounting sleeve to move in concert with the mounting sleeve, and a lifting device mounted between the armrest support and the mounting sleeve and operable between a first position where the lifting device is locked to lock the mounting sleeve onto the armrest support and a second position where the lifting device is unlocked to unlock the mounting sleeve from the armrest support so that the mounting sleeve is movable relative to the armrest support freely.

The primary objective of the present invention is to provide a chair armrest assembly having a height adjustable function.

According to the primary objective of the present invention, the mounting sleeve is movable relative to the armrest support so as to adjust the height of the armrest so that the height of the armrest is adjusted freely to support a user's arm comfortably.

According to another objective of the present invention, the user only needs to press the control knob to adjust the height of the armrest so that the user can adjust the height of the armrest easily and quickly in an energy-saving manner.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
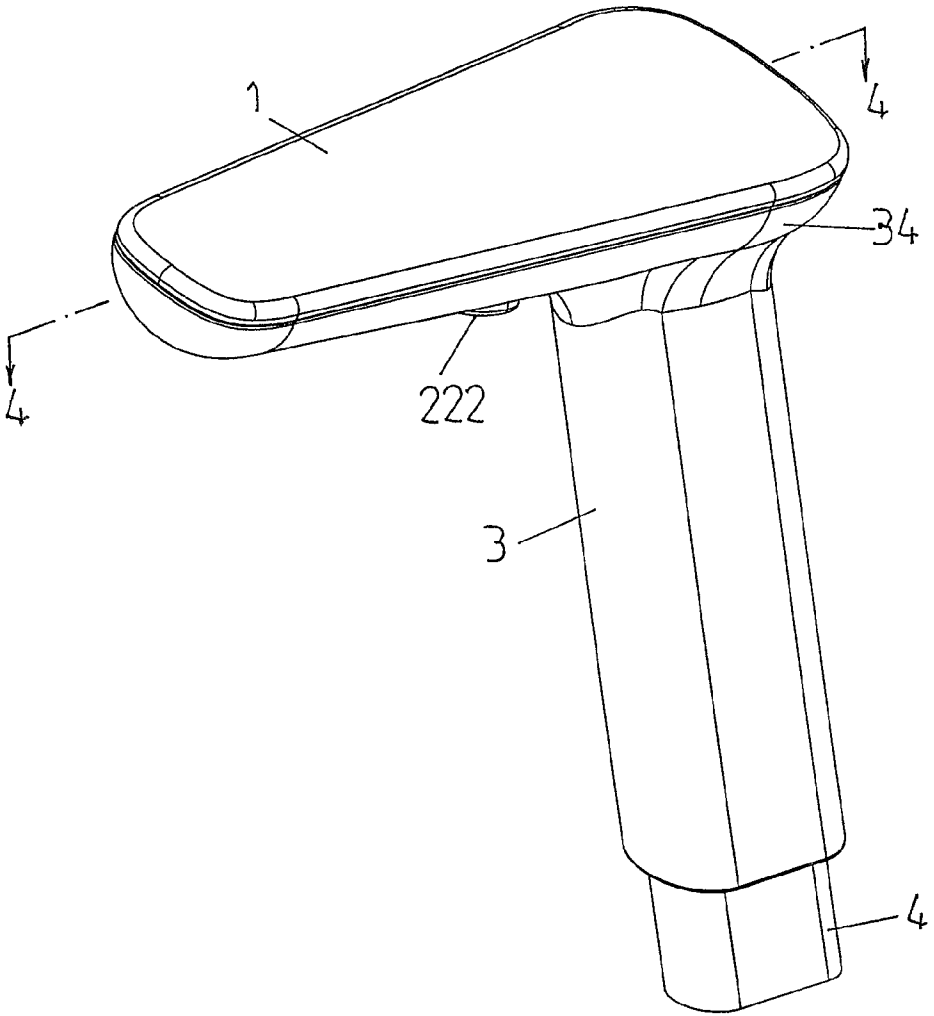
FIG. 1 is a perspective view of an armrest assembly for a chair in accordance with the preferred embodiment of the present invention.

Referring to the drawings and initially to FIGS. 1-5, an armrest assembly for a chair in accordance with the preferred embodiment of the present invention comprises an armrest support 4, a mounting sleeve 3 movably mounted on the armrest support 4, an armrest 1 mounted on the mounting sleeve 3 to move in concert with the mounting sleeve 3, and a lifting device 2 mounted between the armrest support 4 and the mounting sleeve 3 and operable between a first position where the lifting device 2 is locked to lock the mounting sleeve 3 onto the armrest support 4 and a second position where the lifting device 2 is unlocked to unlock the mounting sleeve 3 from the armrest support 4 so that the mounting sleeve 3 is movable relative to the armrest support 4 freely.

The armrest support 4 is hollow and has an inner portion provided with a receiving chamber 40 to receive the lifting device 2. The armrest support 4 has an upper end provided with two opposite pin holes 41 each connected to the receiving chamber 40.

The mounting sleeve 3 has an inner portion provided with a mounting hole 31 slidably mounted on the armrest support 4 and has an upper end provided with two opposite pivot slots 35 each connected to the mounting hole 31. The mounting sleeve 3 has a top provided with a hollow support arm 34 for mounting the armrest 1. The support arm 34 and the mounting sleeve 3 form a substantially inverted L-shaped profile. The support arm 34 has a periphery provided with a plurality of threaded tubes 30. The support arm 34 has a bottom provided with an exposing slot 33. The support arm 34 has a surface provided with a through hole 32.

The armrest 1 is mounted on an open top 36 of the support arm 34. The armrest 1 has a bottom provided with a threaded tube 10 aligning with the through hole 32 of the support arm 34, and the armrest further comprises a fixing screw 7 extending through the through hole 32 of the support arm 34 and screwed into the threaded tube 10 of the armrest 1 to secure the armrest 1 to the support arm 34.

The lifting device 2 includes a housing 24 secured in the armrest support 4 and having an inner portion provided with a plurality of locking grooves 242, a mounting plate 21 mounted on an upper end of the mounting sleeve 3 to move in concert with the mounting sleeve 3, a control bar 22 pivotally mounted in the mounting sleeve 3 and having a lower section 220 movable in the housing 24 and an upper section 221 movable between the mounting plate 21 and the mounting sleeve 3, a locking block 225 mounted on the lower section 220 of the control bar 22 to move in concert with the control bar 22 and detachably locked in any one of the locking grooves 242 of the housing 24, a control knob 222 mounted on the upper section 221 of the control bar 22 and movable toward the mounting plate 21 to move the control bar 22 relative to the housing 24 and to move the locking block 225 to detach from any one of the locking grooves 242 of the housing 24, and an elastic member 23 mounted between the mounting plate 21 and the control knob 222 to move the control knob 222 outwardly relative to the mounting plate 21 and to move the locking block 225 toward any one of the locking grooves 242 of the housing 24.

The housing 24 of the lifting device 2 is mounted in the receiving chamber 40 of the armrest support 4 and has an upper end provided with a pin bore 245 aligning with the two pin holes 41 of the armrest support 4, and the armrest further comprises a fixing pin 5 extending through the two pin holes 41 of the armrest support 4 and the pin bore 245 of the housing 24 to secure the housing 24 of the lifting device 2 to the armrest support 4. The inner portion of the housing 24 is provided with a plurality of locking blocks 241, and the locking grooves 242 of the housing 24 are defined between the locking blocks 241. The housing 24 of the lifting device 2 consists of two recessed support boards 240 which are combined together. One of the two support boards 240 of the housing 24 has a periphery provided with a plurality of locating holes 244, and the other one of the two support boards 240 of the housing 24 has a periphery provided with a plurality of locating stubs 243 inserted into the locating holes 244 so that the two support boards 240 of the housing 24 are combined together.

The control bar 22 of the lifting device 2 has a substantially inverted L-shaped profile. The control bar 22 of the lifting device 2 has a mediate portion provided with a pivot shaft 223 pivotally mounted between the mounting plate 21 and the mounting sleeve 3. The pivot shaft 223 of the lifting device 2 is disposed between the lower section 220 and the upper section 221 of the control bar 22 and is pivotally mounted in the pivot slots 35 of the mounting sleeve 3. The pivot shaft 223 of the lifting device 2 is perpendicular to the upper section 221 of the control bar 22. The lower section 220 of the control bar 22 is disposed between the pivot shaft 223 and the locking block 225 and is movable between the two support boards 240 of the housing 24. The upper section 221 of the control bar 22 has a substantially arc-shaped profile and is disposed between the pivot shaft 223 and the control knob 222. The upper section 221 of the control bar 22 is movable between the mounting plate 21 and the support arm 34.

The control knob 222 of the lifting device 2 is movable in and partially protrudes outwardly from the exposing slot 33 of the support arm 34. The control knob 222 of the lifting device 2 has a top provided with a mounting recess 224. The locking block 225 of the lifting device 2 has a substantially I-shaped cross-sectional profile.

The mounting plate 21 of the lifting device 2 has a periphery provided with a plurality of through bores 210 aligning with the threaded tubes 30 of the support arm 34, and the armrest further comprises a plurality of locking screws 6 extending through the through bores 210 of the mounting plate 21 and screwed into the threaded tubes 30 of the support arm 34 to secure the mounting plate 21 to the support arm 34. The mounting plate 21 of the lifting device 2 has a surface provided with a receiving groove 211 to receive the pivot shaft 223 and the upper section 221 of the control bar 22. The receiving groove 211 of the mounting plate 21 has a substantially T-shaped profile. The mounting plate 21 of the lifting device 2 has a bottom provided with a mounting space 212.

The elastic member 23 of the lifting device 2 has a first end mounted in the mounting space 212 of the mounting plate 21 and a second end mounted in the mounting recess 224 of the control knob 222.

Figure 2:
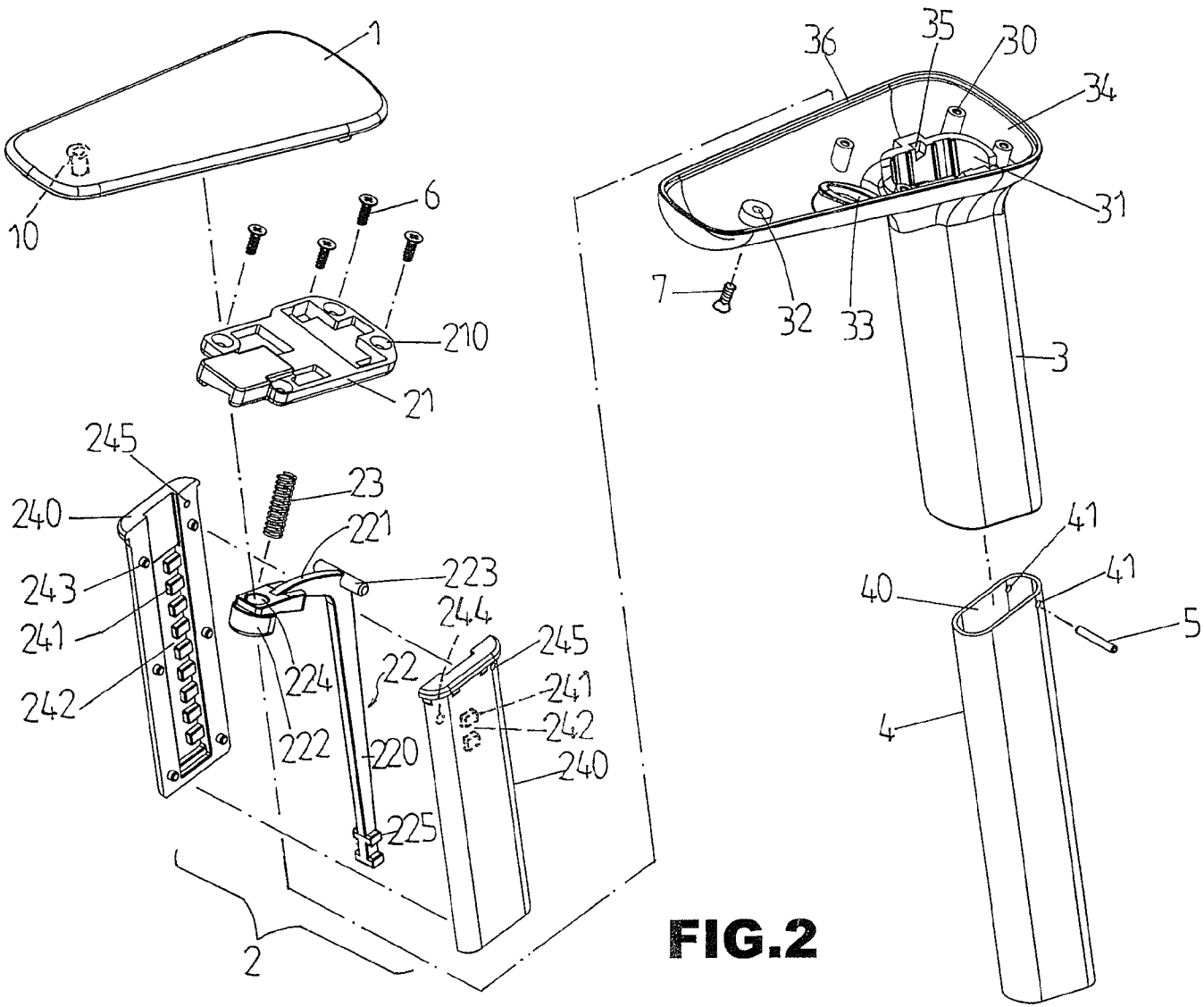
FIG. 2 is an exploded perspective view of the armrest assembly for a chair as shown in FIG. 1.
Figure 3:
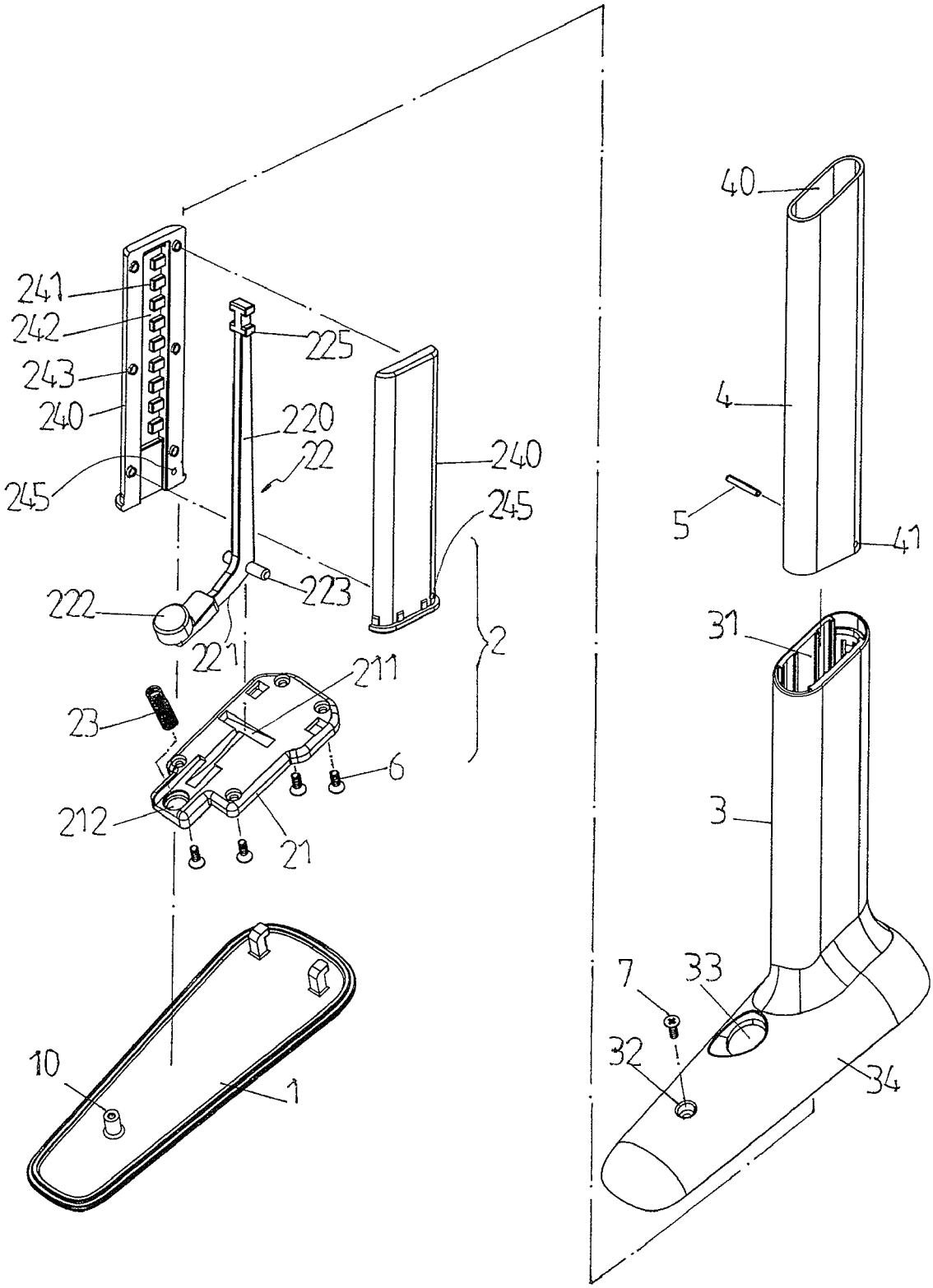
FIG. 3 is an exploded perspective view of the armrest assembly for a chair as shown in FIG. 1.
Figure 4:
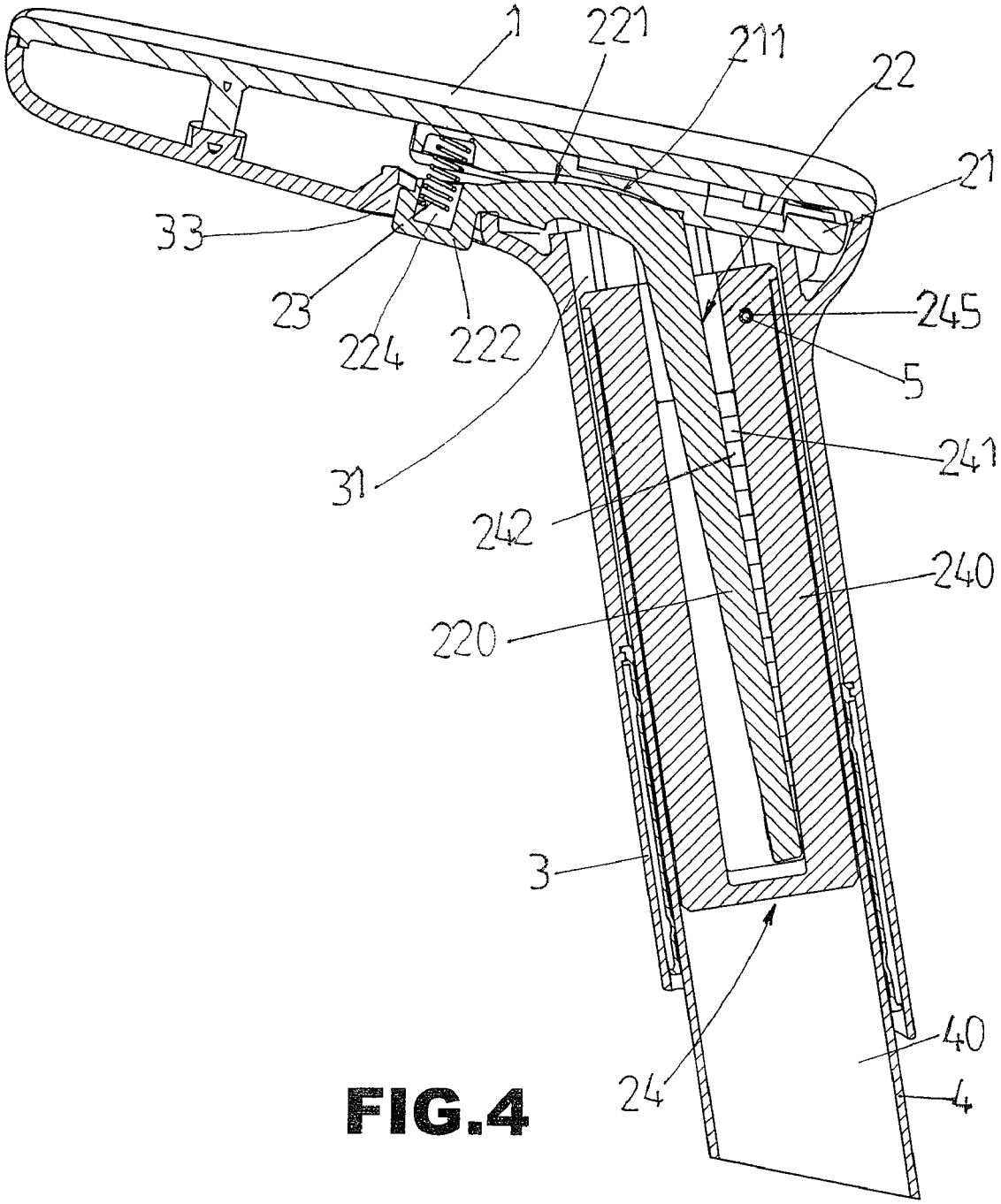
FIG. 4 is a side cross-sectional view of the armrest assembly for a chair taken along line 4-4 as shown in FIG. 1.

In operation, referring to FIGS. 4-7 with reference to FIGS. 1-3, the elastic member 23 is biased between the mounting plate 21 and the control knob 222 to push the locking block 225 toward the locking grooves 242 of the housing 24 so that the locking block 225 is locked in any one of the locking grooves 242 of the housing 24 as shown in FIG. 4 so as to lock the control bar 22 onto the housing 24 and to lock the mounting sleeve 3 onto the armrest support 4. At this time, the control knob 222 protrudes outwardly from the exposing slot 33 of the support arm 34.

Figure 5:
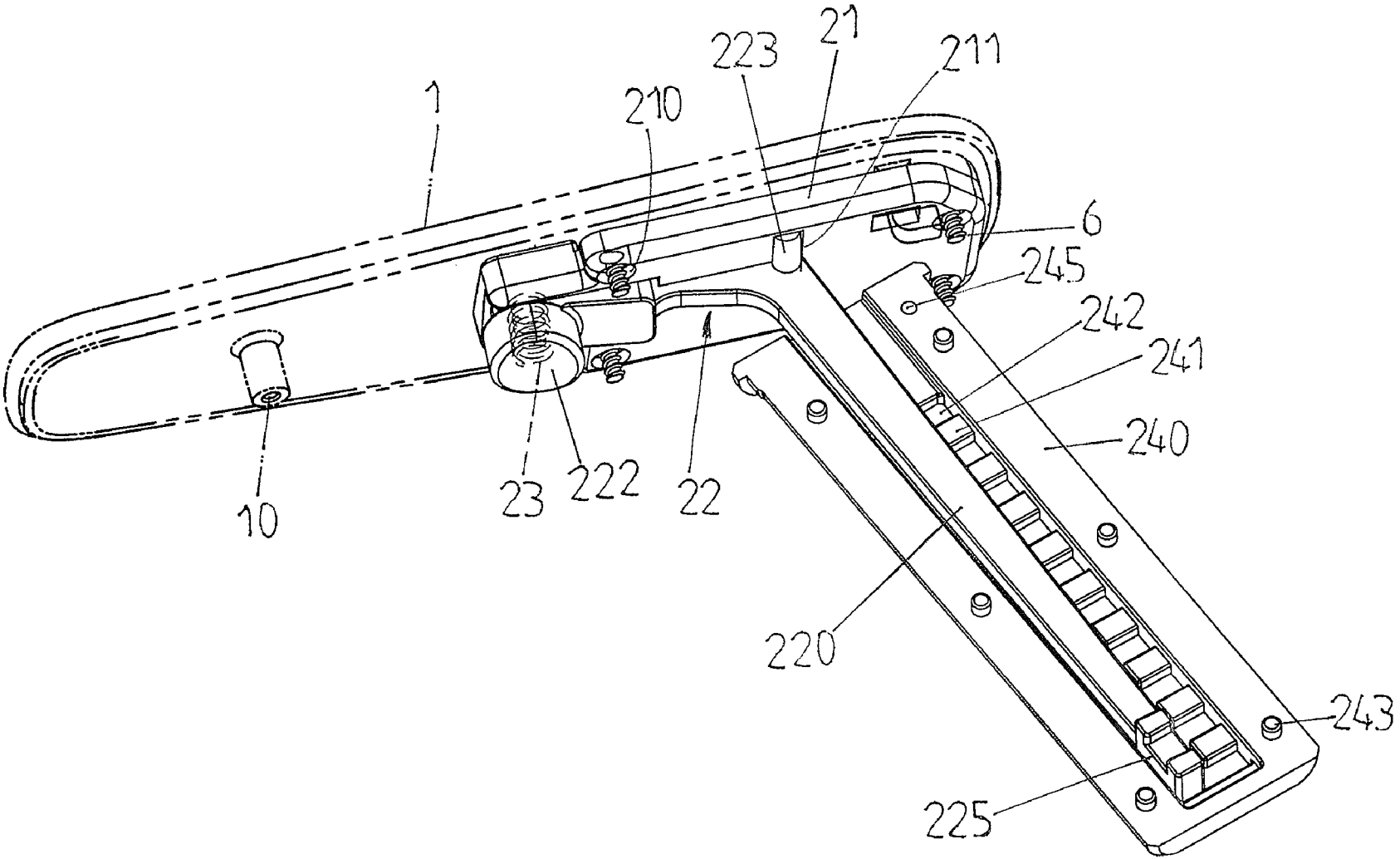
FIG. 5 is a schematic perspective operational view of the armrest assembly for a chair as shown in FIG. 4.
Figure 6:
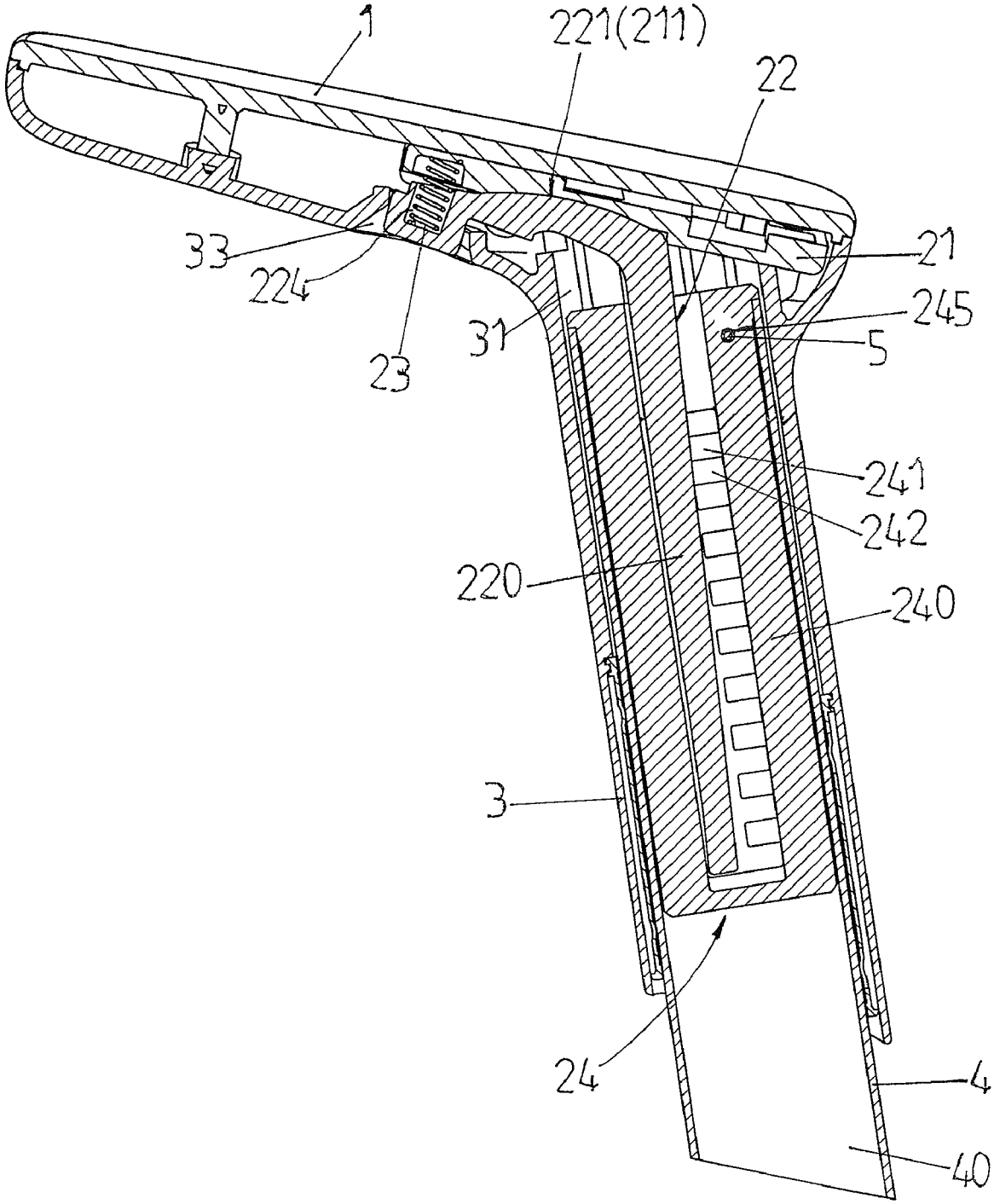
FIG. 6 is a schematic operational view of the armrest assembly for a chair as shown in FIG. 5.
Figure 7:
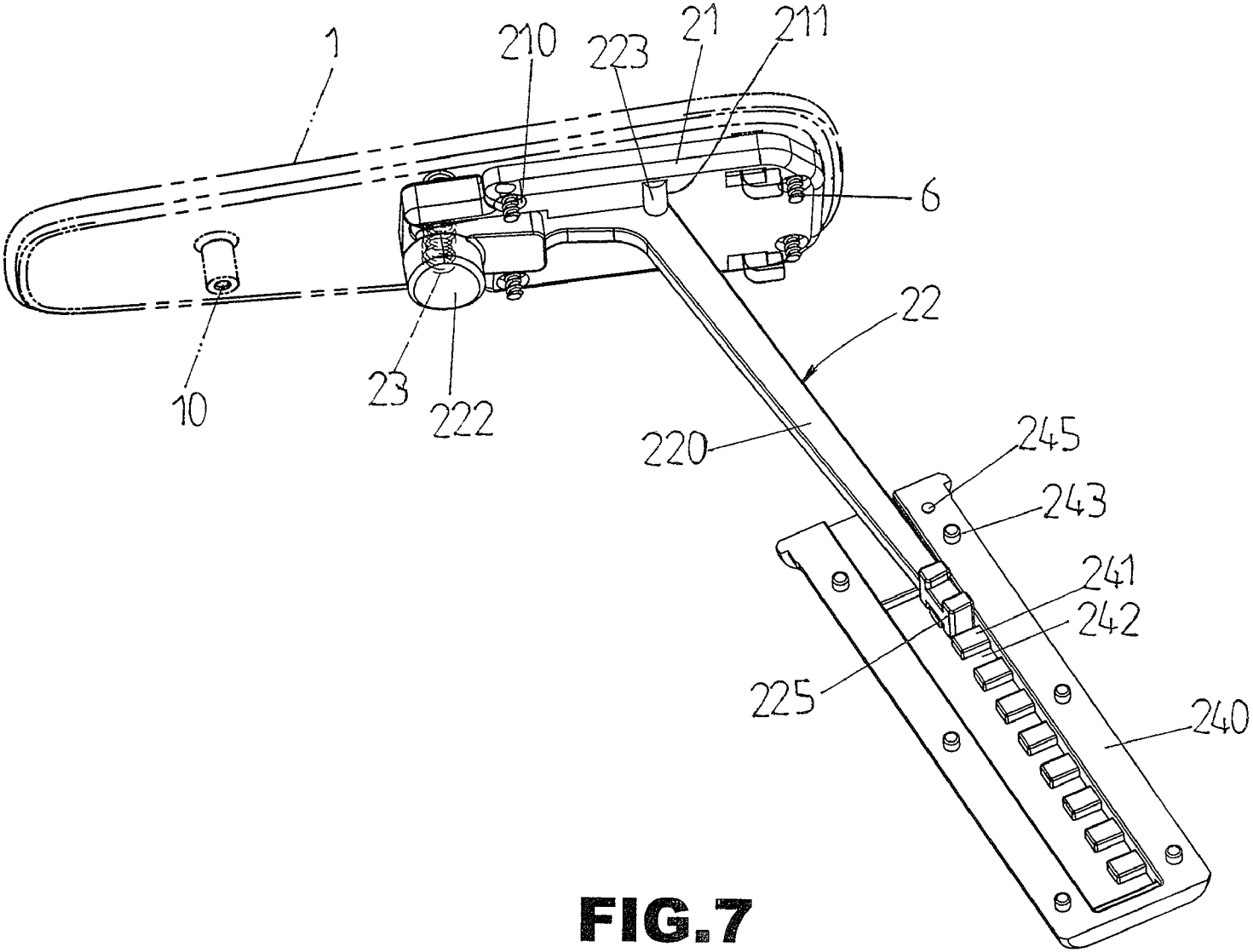
FIG. 7 is a schematic operational view of the armrest assembly for a chair as shown in FIG. 5.

When the control knob 222 is pushed upward to compress the elastic member 23, the control bar 22 is pivoted about the pivot shaft 223 to detach the locking block 225 from any one of the locking grooves 242 of the housing 24 as shown in FIGS. 5 and 6 so as to unlock the control bar 22 from the housing 24, so that the control bar 22 is movable relative to the housing 24, and the mounting sleeve 3 is movable relative to the armrest support 4 so as to adjust the height of the armrest 1 as shown in FIGS. 5 and 7. After adjustment of the height of the armrest 1 is finished, the control knob 222 is pushed downward by the restoring force of the elastic member 23, and the control bar 22 is pivoted about the pivot shaft 223 to push the locking block 225 toward the locking grooves 242 of the housing 24 so that the locking block 225 is locked in another one of the locking grooves 242 of the housing 24 as shown in FIG. 7 so as to lock the control bar 22 onto the housing 24 and to lock the mounting sleeve 3 onto the armrest support 4.

Accordingly, the mounting sleeve 3 is movable relative to the armrest support 4 so as to adjust the height of the armrest 1 so that the height of the armrest 1 is adjusted freely to support a user's arm comfortably. In addition, the user only needs to press the control knob 222 to adjust the height of the armrest 1 so that the user can adjust the height of the armrest 1 easily and quickly in an energy-saving manner.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An armrest assembly, comprising:

an armrest support;

a mounting sleeve movably mounted on the armrest support;

an armrest mounted on the mounting sleeve to move in concert with the mounting sleeve; and a lifting device mounted between the armrest support and the mounting sleeve and operable between a first position where the lifting device is locked to lock the mounting sleeve onto the armrest support and a second position where the lifting device is unlocked to unlock the mounting sleeve from the armrest support so that the mounting sleeve is movable relative to the armrest support freely;

wherein the lifting device includes:

a housing secured in the armrest support and having an inner portion provided with a plurality of locking grooves;

a mounting plate mounted on an upper end of the mounting sleeve to move in concert with the mounting sleeve;

a control bar pivotally mounted in the mounting sleeve and having a lower section movable in the housing and an upper section movable between the mounting plate and the mounting sleeve;

a locking block mounted on the lower section of the control bar to move in concert with the control bar and detachably locked in any one of the locking grooves of the housing;

a control knob mounted on the upper section of the control bar and movable toward the mounting plate to move the control bar relative to the housing and to move the locking block to detach from any one of the locking grooves of the housing; and an elastic member mounted between the mounting plate and the control knob to move the control knob outwardly relative to the mounting plate and to move the locking block toward any one of the locking grooves of the housing;

the mounting sleeve has a top provided with a hollow support arm for mounting the armrest;

the control bar of the lifting device has a mediate portion provided with a pivot shaft pivotally mounted between the mounting plate and the mounting sleeve.

2. The armrest assembly of claim 1, wherein the armrest support has an inner portion provided with a receiving chamber to receive the lifting device;

the housing of the lifting device is mounted in the receiving chamber of the armrest support;

the mounting sleeve has an inner portion provided with a mounting hole slidably mounted on the armrest support.

3. The armrest assembly of claim 2, wherein the armrest support has an upper end provided with two opposite pin holes each connected to the receiving chamber;

the housing of the lifting device has an upper end provided with a pin bore aligning with the two pin holes of the armrest support;

the armrest further comprises a fixing pin extending through the two pin holes of the armrest support and the pin bore of the housing to secure the housing of the lifting device to the armrest support.

4. The armrest assembly of claim 1, wherein the support arm has a periphery provided with a plurality of threaded tubes;

the mounting plate of the lifting device has a periphery provided with a plurality of through bores aligning with the threaded tubes of the support arm;

the armrest further comprises a plurality of locking screws extending through the through bores of the mounting plate and screwed into the threaded tubes of the support arm to secure the mounting plate to the support arm.

5. The armrest assembly of claim 1, wherein the support arm has a bottom provided with an exposing slot;

the control knob of the lifting device is movable in and partially protrudes outwardly from the exposing slot of the support arm.

6. The armrest assembly of claim 1, wherein the support arm has a surface provided with a through hole;

the armrest is mounted on an open top of the support arm;

the armrest has a bottom provided with a threaded tube aligning with the through hole of the support arm;

the armrest further comprises a fixing screw extending through the through hole of the support arm and screwed into the threaded tube of the armrest to secure the armrest to the support arm.

7. The armrest assembly of claim 1, wherein the mounting sleeve has an upper end provided with two opposite pivot slots each connected to the mounting hole;

the pivot shaft of the lifting device is pivotally mounted in the pivot slots of the mounting sleeve;

the mounting plate of the lifting device has a surface provided with a receiving groove to receive the pivot shaft and the upper section of the control bar.

8. The armrest assembly of claim 1, wherein the control knob of the lifting device has a top provided with a mounting recess;

the mounting plate of the lifting device has a bottom provided with a mounting space;

the elastic member of the lifting device has a first end mounted in the mounting space of the mounting plate and a second end mounted in the mounting recess of the control knob.

9. The armrest assembly of claim 1, wherein the inner portion of the housing is provided with a plurality of locking blocks;

the locking grooves of the housing are defined between the locking blocks.

10. The armrest assembly of claim 1, wherein the housing of the lifting device consists of two recessed support boards which are combined together;

one of the two support boards of the housing has a periphery provided with a plurality of locating holes;

the other one of the two support boards of the housing has a periphery provided with a plurality of locating stubs inserted into the locating holes so that the two support boards of the housing are combined together;

the lower section of the control bar is movable between the two support boards of the housing.

11. The armrest assembly of claim 1, wherein the control bar of the lifting device has a substantially inverted L-shaped profile.

12. The armrest assembly of claim 1, wherein the pivot shaft of the lifting device is perpendicular to the upper section of the control bar;

the receiving groove of the mounting plate has a substantially T-shaped profile.

13. The armrest assembly of claim 1, wherein the upper section of the control bar has a substantially arc-shaped profile;

the upper section of the control bar is disposed between the pivot shaft and the control knob.

14. The armrest assembly of claim 1, wherein the lower section of the control bar is disposed between the pivot shaft and the locking block.

15. The armrest assembly of claim 1, wherein the upper section of the control bar is movable between the mounting plate and the support arm.

16. The armrest assembly of claim 1, wherein the locking block of the lifting device has a substantially I-shaped cross-sectional profile.

17. The armrest assembly of claim 1, wherein the support arm and the mounting sleeve form a substantially inverted L-shaped profile.

18. The armrest assembly of claim 1, wherein the pivot shaft of the lifting device is disposed between the lower section and the upper section of the control bar.

* * * * *